United States Patent [19]

Hoyt

[11] Patent Number: 4,633,797

[45] Date of Patent: Jan. 6, 1987

[54] DOUBLE WISHBONE RIG

[76] Inventor: John G. Hoyt, #9 Defender's Row, Goat Island, Newport, R.I. 02840

[21] Appl. No.: 727,236

[22] Filed: Apr. 25, 1985

[51] Int. Cl.[4] ..... B63B 15/00

[52] U.S. Cl. ..... 114/91; 114/97; 114/39

[58] Field of Search ..... 114/39, 39.2, 90, 91, 114/97, 98, 102, 103

[56] References Cited

U.S. PATENT DOCUMENTS 2,364,578 12/1944 Wilkie ..... 114/39
3,077,850 2/1963 Beuby ..... 114/39
4,314,518 2/1982 Marsden ..... 114/39

FOREIGN PATENT DOCUMENTS 3017362 11/1981 Fed. Rep. of Germany ..... 114/39.2

*Primary Examiner*—Sherman D. Basinger
*Assistant Examiner*—Jesûs D. Sotelo
*Attorney, Agent, or Firm*—Barlow & Barlow, Ltd.

[57] ABSTRACT

A wishbone mast with a wishbone boom is disclosed for use on any form of vehicle, principally on watercraft. The rigidity of the system is assured by a rigid spacer extending across the wishbone boom that is mounted within the wishbone mast. Various balanced sail configurations are usuable with the structure.

4 Claims, 9 Drawing Figures

DOUBLE WISHBONE RIG

BACKGROUND OF THE INVENTION

The usual sailboat that has two sails, is rigged with a mast with one sail extending aft of the mast and provided with a boom also extending aft of the mast, while the second sail, such as a jib, is located forward of the mast and may have an independent boom pivoted a distance from the mast and swingable through the fore triangle independently of the main boom. There have been rigs in which a single sail has extended in opposite directions from the mast such as in U.S. Pat. Nos. 2,147,501, 3,173,395 and British No. 847,310 or a single sail mounted on a tripod mast such as in U.S. Pat. No. 4,044,702 in which case booms have been used. Two independent sails mounted on the same mast with independent booms and gaffs are shown in the U.S. Pat. No. 685,943 but are not adapted to operate as a single boom means and allow the boat to go upwind. Also, single sails without booms that have extended forward and aft of a mast are shown in U.S. Pat. No. 4,054,100.

Conventional free sail rigs, such as are shown in the Schweitzer patent U.S. Pat. No. 3,487,800, are developed around the concept of a single mast with a rearwardly extending wishbone boom that serves the various purposes of tensioning the sail, providing the operator with a hand hold to balance himself, and supplying the means for controlling the sail and thereby the direction of the boat.

SUMMARY OF THE INVENTION

In carrying out the principles of the present invention according to a preferred embodiment, a high efficiency aerodynamic sail wind propulsion system comprises a mast mounted on the hull of a boat that has a pair of spaced curved members joined at each end and cooperating with the mast structure is a wishbone boom which is essentially two spaced curved booms joined at each end that are pivotally secured to the mast so that the boom extends forward and aft of the mast. To stiffen the structure a rigid spacer is provided between the booms at the point where the booms pivot on the mast, which restricts deflection of both the booms and the mast. Two sail configurations may be supported in this structure. In a first a three corner jib sail is supported by the mast with its forward corner secured to the forward end of the boom structure and the lower corner affixed to the lower end of the mast, the leech may be fitted with a leech wire. A mainsail which may have a luff wire, is supported by the mast the head being secured at the top end of the mast and the tack at the lower end of the mast with the clew drawn out to the aft end of the boom structure. In a second form, a fully battened sail having an eliptical outline is supported by the mast and boom at four points. Conveniently the sail is in two parts separated by the boom at which location each section may be furled.

The wind propulsion structure may be attached to a hull by means of a universal joint which has at least one axis of rotation and in such a configuration can be used on a conventional hull, a sailing board, an ice boat, a skate board and the like. To provide lateral resistance, a centerboard or a dagger board or a lee board can be utilized.

The present invention allows essentially, sails that enjoy clean leading edges thus maximizing aerodynamic efficiency. Ideally, the rig should be a balanced rig with approximately equal sail area forward and aft of the mast to simplify rotation and control.

BRIEF DESCRIPTION OF THE PREFERRED EMBODIMENT

Figure 1:
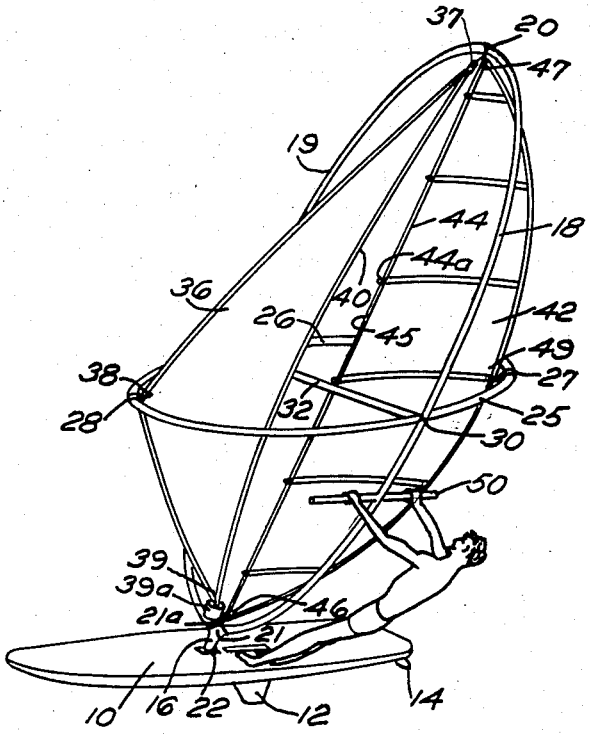
FIG. 1 is a perspective view of the double wishbone rig mounted on a sailing board.
Figure 2:
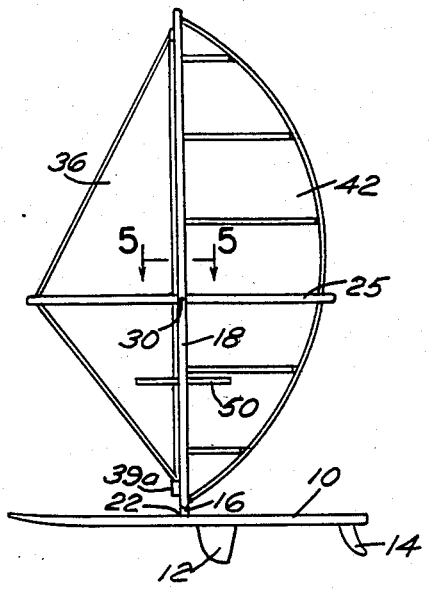
FIG. 2 is a side elevational view thereof.
Figure 3:
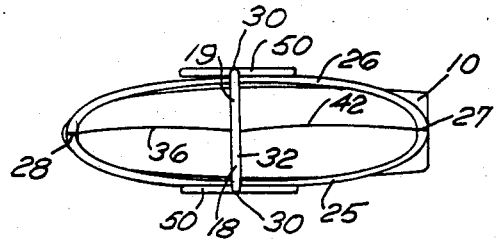
FIG. 3 is a top plan view thereof.
Figure 4:
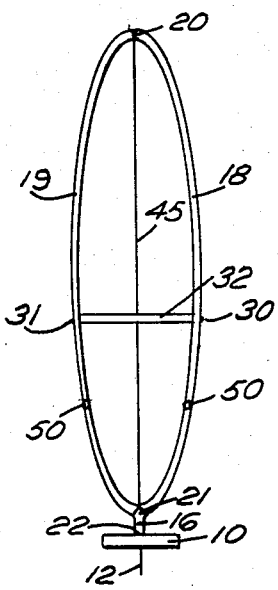
FIG. 4 is a front elevational view.
Figure 5:
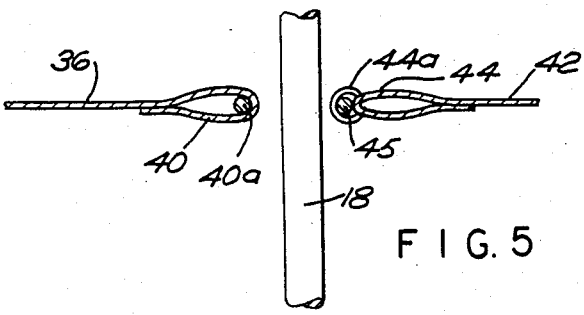
FIG. 5 is an elarged sectional taken on lines 5—5 of FIG. 2.

Referring to FIG. 1, 10 designates a hull which may have a dagger board 12 and an aft stabilizing fin 14. Rising from a suitable point on the deck of the hull 10 is a mast structure which may be affixed to the hull 10 by a swivel joint 16 and which consists of a pair of spaced curved members 18 and 19 that are joined together at either end thereof as at the head 20 and the foot 21. For convenience in operating the mast system a short stub-mast section 22 extends downwardly from the juncture point 21. A pair of booms 25,26 are joined together at the aft end as at 27 and at the forward end as at 28 to form what is generally termed a wishbone boom structure. The booms are mounted inside of the wishbone mast structure consisting of the two spaced curved members 18 and 19. On pivot pins 30 and 31 the pivot pins also serve to mount a rigid spacer bar 32 that maintains the rigidity of the wishbone structure of both the booms and the mast.

A triangular jib 36 has its head 37 suitably affixed to the upper juncture point of the mast at 20, the forward corner 38 being affixed to the forward end of booms while a third corner 39 of the jib sail, which could conceivably be termed a clew, is affixed to the lower junction of the mast as at 21 on a roller furling drum 39*a*. Preferably the leech 40 of the jib has a wire 40*a* fitted therein for stiffening purposes.

The mainsail 42 which is illustrated a a fully battened mainsail may be provided with a luff 44 and rings 44*a* engaging a tensioned cable 45. The tack 46 of the mainsail is fastened to the lower end of the mast as at 21 while the head 47 of the mainsail is fastened to the upper end of the mast as at 20. The mainsail has a clew 49 which is fastened to the aft end of boom structure as at 27.

In the embodiment illustrated, an operator is seen holding on to handbars 50 which may be placed on either spaced curved member of the mast and should be understood as being adjustable in different positions on the curved members to allow for the grasping by different sized individuals. The user will note decided benefit from the utilization of two sails and the resulting slot effect. Also the rig is substantially balanced with approximately equal sail area in the jib and in the mainsail which makes rotation and control much easier and particularly simplifies downwind sailing.

Figure 6:
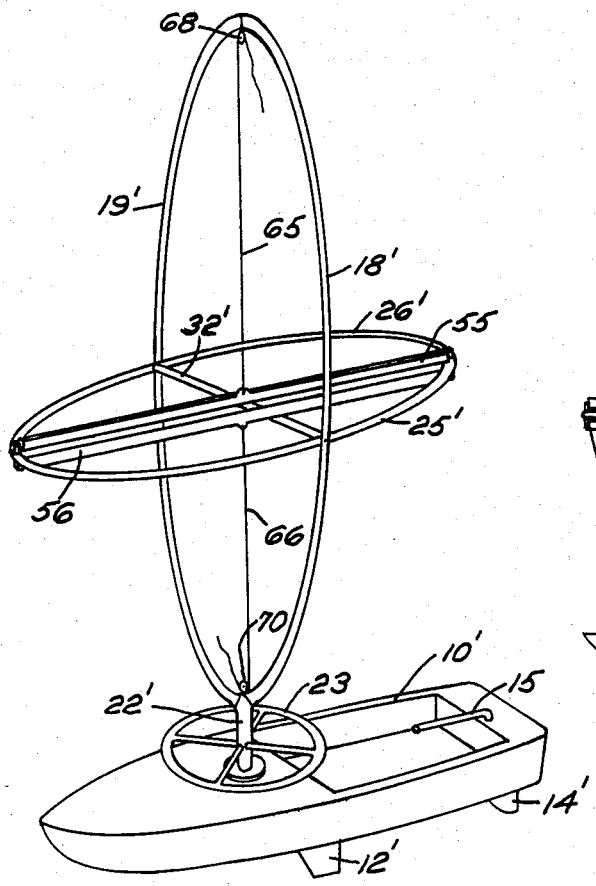
FIG. 6 is a perspective view of another form of double wishbone rig.
Figure 7:
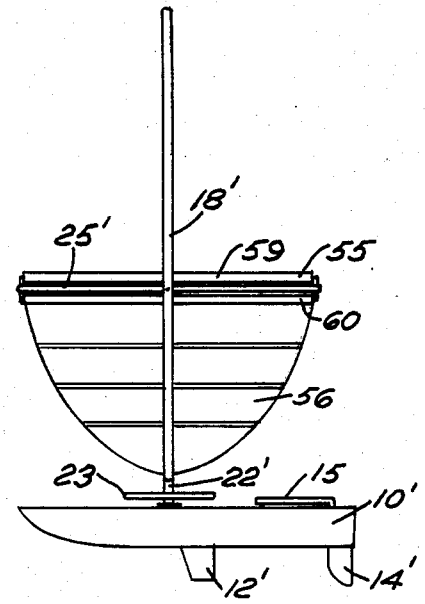
FIG. 7 is a side elevational view thereof.
Figure 8:
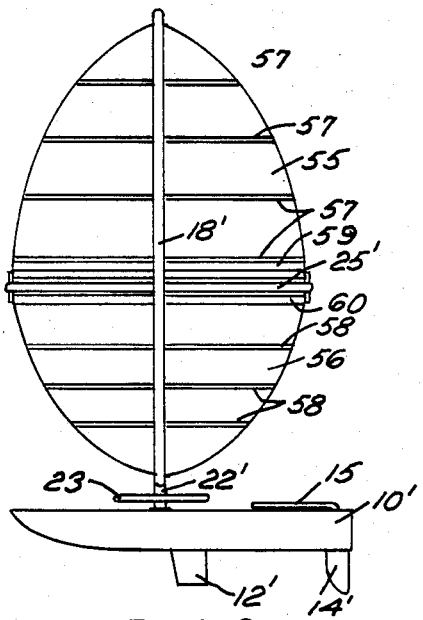
FIGS. 8 and 9 are side elevational views showing the sail fully hoisted and furled, respectively.
Figure 9:
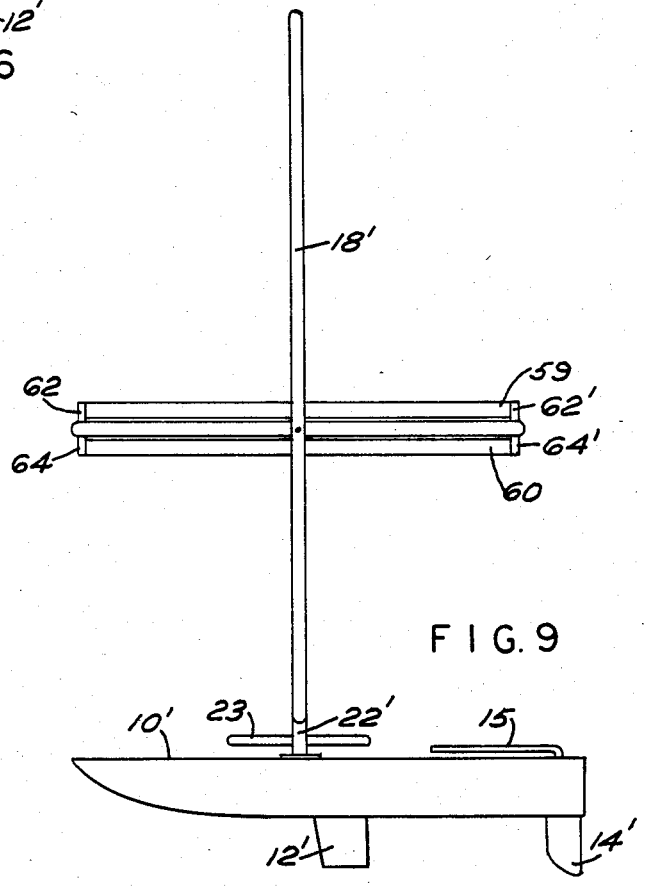

Referring now to FIG. 6 of the drawing a modified version of the double wishbone rig is illustrated. In this case the hull 10' is fitted with a conventional center board 12' and a conventional rudder 14' to which is joined a tiller 15. Rotatably secured in the hull is a mast structure which as in the previous embodiment consists of a pair of spaced curved members 18' and 19' and which have a stub section 22' that is the portion rotatably secured in the hull 10'. Extending about the stub section 22' above the deck line of the hull 10' is a large circular wheel 23 which will control the rotative position of the mast structure also as in the previous embodiment. The booms 25', 26' are fastened in the same fashion as in the previous embodiment and have a rigid space bar 32' there between.

In this particular embodiment the sail is divided in two, but in lieu of being divided fore and aft it is divided horizontally to provide a top sail 55 and a lower sail 56. Both sails are fully battened with battens 57, 58 respectively and are fitted on roller tubes 59,60 respectively which are mounted in end brackets 62, 62' and 64, 64' respectively. The tubes have internal helical springs therein (not shown) so that in a normal position they will maintain the sails rolled up about the rollers in exactly the same fashion as a window shade roller operates. Essentially therefore, the free edge of each sail is fitted with a halyard. The top sail 55 having a halyard 65 while the lower sail 56 has a halyard 66. These halyards pass through blocks 68,70 from which point the halyards may be led by guide eyes along the mast structure to a suitable point where they can be controlled.

In operation a person would sit in the cockpit of the hull 10' with one hand on the tiller 15 and the other hand on the wheel 23 to control the attitude of the mast as well as the direction of the boat. Since the rig is balanced fore and aft relative to the center line of the mast there is very little force exerted on the wheel 23 so the control may be readily had.

I claim:

1. In a sailing craft having a hull, a mast mounted on the hull comprising a pair of spaced curved members joined at each end, two spaced curved booms joined at each end pivotally secured to the mast at a pivot point whereby the booms extend forward and aft of the mast, a rigid spacer between the booms at the pivot point, a three cornered jib sail and a mainsail, means to attach the head of the sails to the upper portion of the mast, means to attach the lower corner of the sails to the lower portion of the mast, means to attach the lower corner of the jib to the forward end of the booms and means to attach the clew of the mainsail to the aft end of the booms whereby the luff of the mainsail may be tensioned and the clew adjusted to provide the proper camber.

2. In a sailing craft as in claim 1 wherein the booms are shorter than the mast and may be rotated for storage within the spaced curved members of the mast.

3. In a sailing craft as in claim 1 wherein a fully battened top and lower sail are mounted on the booms to extend above and below the booms.

4. In a sailing craft as in claim 1 wherein the mast has a rotative control means mounted at is lower end.

* * * * *